United States Patent [19]

Heppner

[11] Patent Number: 5,015,162

[45] Date of Patent: May 14, 1991

[54] ATTACHMENT FOR AN OIL WELL SCREW PUMP SYSTEM

[76] Inventor: Terry D. Heppner, Box 54, Baldwinton, Saskatchewan, Canada, S0M 0B0

[21] Appl. No.: 442,073

[22] Filed: Nov. 28, 1989

[51] Int. Cl.[5] ..... F04C 5/00; F04C 15/00

[52] U.S. Cl. ..... 418/48; 403/349; 403/378; 417/203; 417/251; 417/448

[58] Field of Search ..... 418/48; 417/203, 205, 417/313, 251, 448, 450; 403/109, 349, 378, 379

[56] References Cited

U.S. PATENT DOCUMENTS

| | | | |
|---|---|---|---|
| 2,085,115 | 6/1937 | Moineau | 418/48 |
| 2,267,459 | 12/1941 | Hait | 418/48 |
| 2,456,227 | 12/1948 | Wade | 418/48 |
| 2,604,945 | 11/1952 | Page | 417/450 |
| 2,749,992 | 6/1956 | Hill | 418/48 |
| 3,102,495 | 9/1963 | Page | 417/450 |
| 3,216,768 | 11/1965 | Soeding | 417/203 |
| 3,347,169 | 10/1967 | Cronin, Jr. et al. | 418/48 |
| 3,554,266 | 1/1971 | Baird | 418/48 |
| 3,989,418 | 11/1976 | Swanson | 418/48 |
| 4,580,955 | 4/1986 | Karge | 418/48 |
| 4,661,046 | 4/1987 | Ruyle | 417/203 |
| 4,764,094 | 8/1988 | Baldenko et al. | 418/48 |

*Primary Examiner*—Leonard E. Smith
*Assistant Examiner*—David L. Cavanaugh
*Attorney, Agent, or Firm*—Adrian D. Battison; Stanley G. Ade; Murray E. Thrift

[57] ABSTRACT

A pumping system for a heavy oil and sand slurry from a downhole location to the ground surface includes a conventional screw type pump having a rotor and stator. At the bottom of the stator at the inlet thereto is mounted an attachment including a sleeve having a number of slots in the side surface into which the material feeds. Inside the sleeve is mounted a shaft having an auger flight along part of its length. A coupling at the upper end of the shaft connects to the lower end of the rotor and can be engaged and released by rotation of the rotor. The auger flight assists in forming the materials including any excess sand into a suitable slurry for feeding to the inlet of the pump. The auger feeds the material more effectively to the inlet thus maximizing efficiency of the pump. The device thus avoids sand blockages which are common problems in pumping systems of this type.

9 Claims, 3 Drawing Sheets

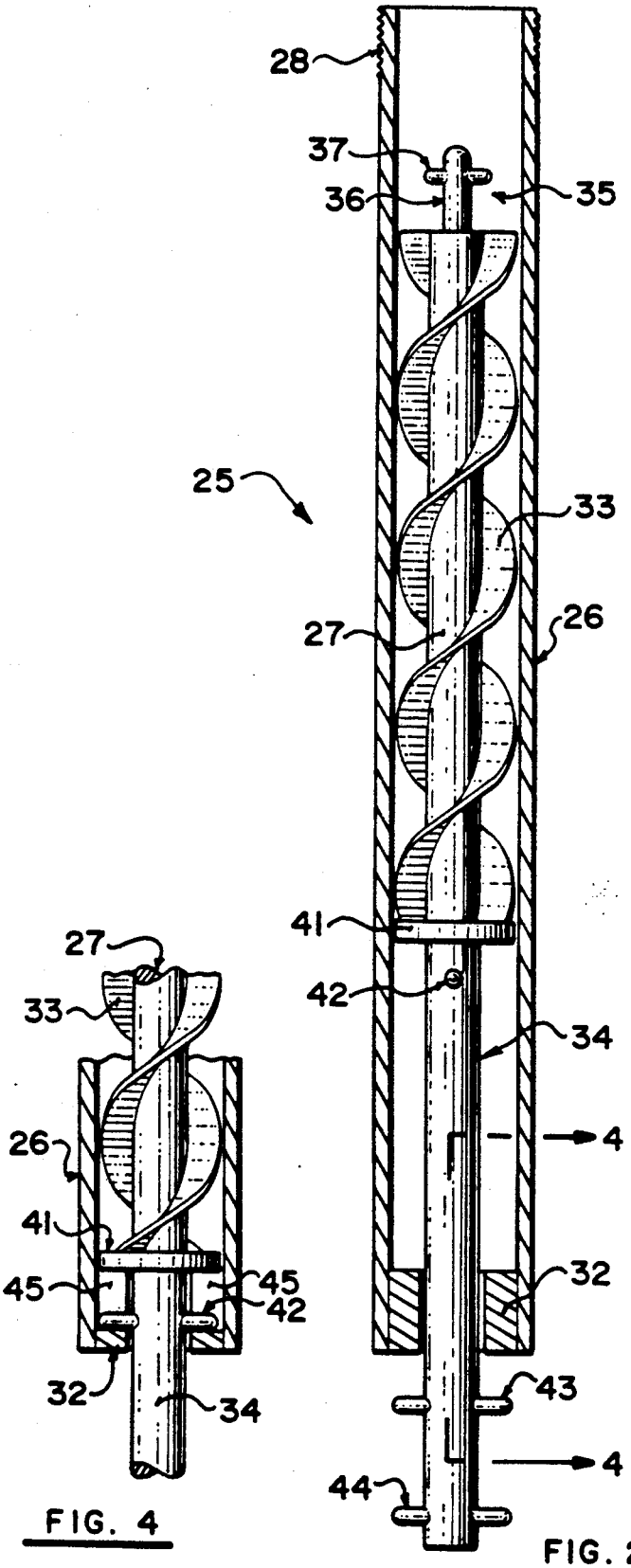
FIG. 2
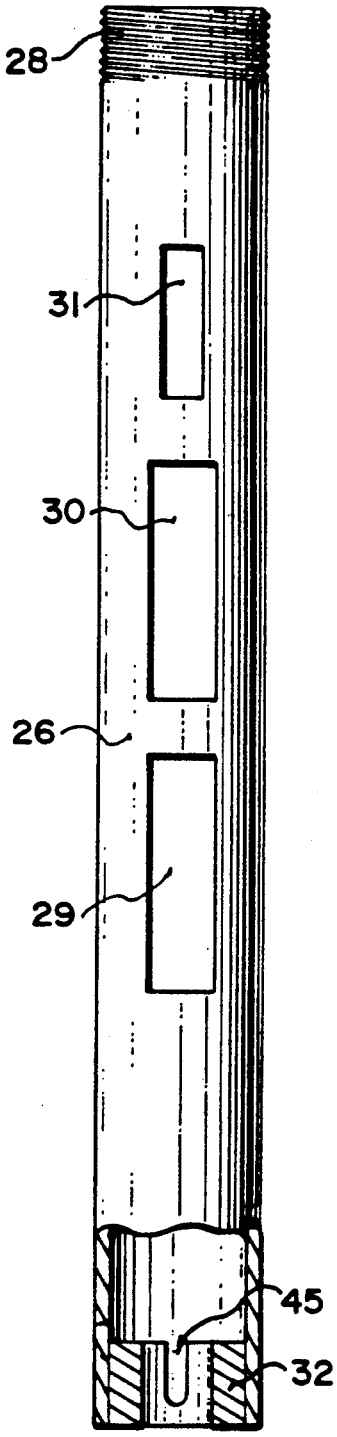
FIG. 3
FIG. 4

ATTACHMENT FOR AN OIL WELL SCREW PUMP SYSTEM

BACKGROUND OF THE INVENTION

This invention relates to a rotary well pump system for pumping oil bearing material from a producing formation to the ground surface.

Rotary or screw pumps for oil bearing materials are well known which include a stator fixed to a outer tubing together with a rotor which is driven by a shaft leading from a suitable drive mechanism at the ground surface. The rotor and stator are cooperatively shaped to provide a pumping pressure which transmits the oil bearing materials from the pump through the tubing to the ground surface.

Examples of pumps of this type are sometimes known as Moineau pumps or progressing cavity pumps and are shown in U.S. Pat. Nos. 2,085,115 (Moineau), 2,267,459 (Hait), 2,456,227 (Wade), 2,749,992 (Hill), 3,347,169 (Cronin) and 4,580,955 (Karge).

Pumps of this type have been developed for pumping heavy oils which often contain sand materials. The design of the rotor and stator is particularly developed to handle the transmission of the sand provided the amount of sand remains below an acceptable maximum proportion of the liquid material.

However many pumps of this type have problems associated with sand and the levels of sand which are necessary for pumping to the surface. Sand production problems are generally regarded as the major cause of service expense in the production of heavy oil. Sand production is due in part to the velocity changes of fluids and gases entering the well bore. A well that occasionally experiences "gas kicks" often also has corresponding sand influxes. The conventional downhole pumping equipment is tolerant to relatively large amounts of sand provided the sand comes to the pump in a steady homogenous slurry with the remaining oil materials. However the sudden influx of sand into the well bore can often overwhelm the pump leading to a complete loss of production or reduction in the amount produced to an uneconomic level.

Various servicing procedures are available for overcoming this problem but these are of course in many cases lengthy, time consuming and expensive thus significantly interfering with the economics of the heavy oil production system.

SUMMARY OF THE INVENTION

It is one object of the present invention, therefore, to provide an attachment device for mounting upon a well pump of the above type which enables sand material to be handled by the pump system more effectively with the intention of reducing servicing costs and improving economic efficiency.

According to a first aspect of the invention, therefore, there is provided a rotary well pump system for pumping oil bearing material from a producing formation to the ground surface, the system comprising a tubing extending from the ground surface to a position adjacent the producing formation, a screw pump of the type having a stator and and a rotor, the stator being attached to the tubing and having an inlet opening facing in an axial direction for receiving the oil bearing material from the producing formation, a drive rod extending from a drive system at the ground surface to the rotor for driving the rotor in the stator to generate a pumping pressure in the material entering said inlet opening for transmission through the tubing to the surface, a sleeve member surrounding and extending axially from said inlet opening through which the oil bearing material passes to said inlet opening, a shaft extending axially of the sleeve, means connecting said shaft to said rotor for rotation therewith and an auger flight carried by said shaft and rotatable therewith inside said sleeve and arranged such that rotation of said rod in a pumping direction causes the auger flight to feed said oil bearing material longitudinally of the sleeve towards said inlet opening.

According to a second aspect of the invention there is provided an attachment for a rotary well pump system of the type for, pumping oil bearing material from a producing formation to the ground surface and comprising a tubing extending from the ground surface to a position adjacent the producing formation, a screw pump of the type having a stator and and a rotor, the stator being attached to the tubing and having an inlet opening facing in an axial direction for receiving the oil bearing material from the producing formation, a drive rod extending from a drive system at the ground surface to the rotor for driving the rotor in the stator to generate a pumping pressure in the material entering said inlet opening for transmission through the tubing to the surface, the attachment comprising a sleeve member including means for coupling the sleeve member to the stator so as to extend axially from said inlet opening, a shaft for mounting in the sleeve so as to extend axially of the sleeve, means for connecting said shaft to said rotor for rotation therewith and an auger flight carried by said shaft and rotatable therewith inside said sleeve and arranged such that rotation of said rod in a pumping direction causes the auger flight to feed said oil bearing material longitudinally of the sleeve towards said inlet opening.

The attachment of the present invention is therefore a specially designed agitation device that can be used in conjunction with any progressing cavity pump that is a rotary pump of the Moineau type.

The device operates to carry out two functions:

1. It supplies the energy necessary to maintain a homogenous slurry that the pump can easily handle. The mechanical agitation also works to disperse any increased influxes of sand that may occur from time to time. Because the auger is landed at or slightly below the perforations in the side of sleeve, the sand influxes are immediately slurried into the pump and taken out of the well. If the well is going to produce sand in conjunction with the heavy oil it is better for the sand to be produced into the storage tanks at the surface rather than the sand being left at the downhole location with the necessity to deal with the associated problems downhole.

2. The device according to the invention mixes the slurry in an upward direction into the progressing cavity pump. Thus it acts as a charge pump enabling the progressing cavity pump to be more efficient. With this increased efficiency, the pump speed can be reduced, thus prolonging the life of the pumping equipment.

With the foregoing in view, and other advantages as will become apparent to those skilled in the art to which this invention relates as this specification proceeds, the invention is herein described by reference to the accompanying drawings forming a part hereof, which includes a description of the best mode known to the application and of the preferred typical embodiment of the principles of the present invention, in which:

DESCRIPTION OF THE DRAWINGS

FIG. 2 is a cross sectional view through the attachment of FIG. 1.

FIG. 3 is a side elevational view of the sleeve of FIG. 2 with the shaft omitted and showing the lower portion is cross section.

FIG. 4 is a cross sectional view along lines 4—4 in FIG. 2.

In the drawings like characters of reference indicate corresponding parts in the different figures.

DETAILED DESCRIPTION

Figure 1:
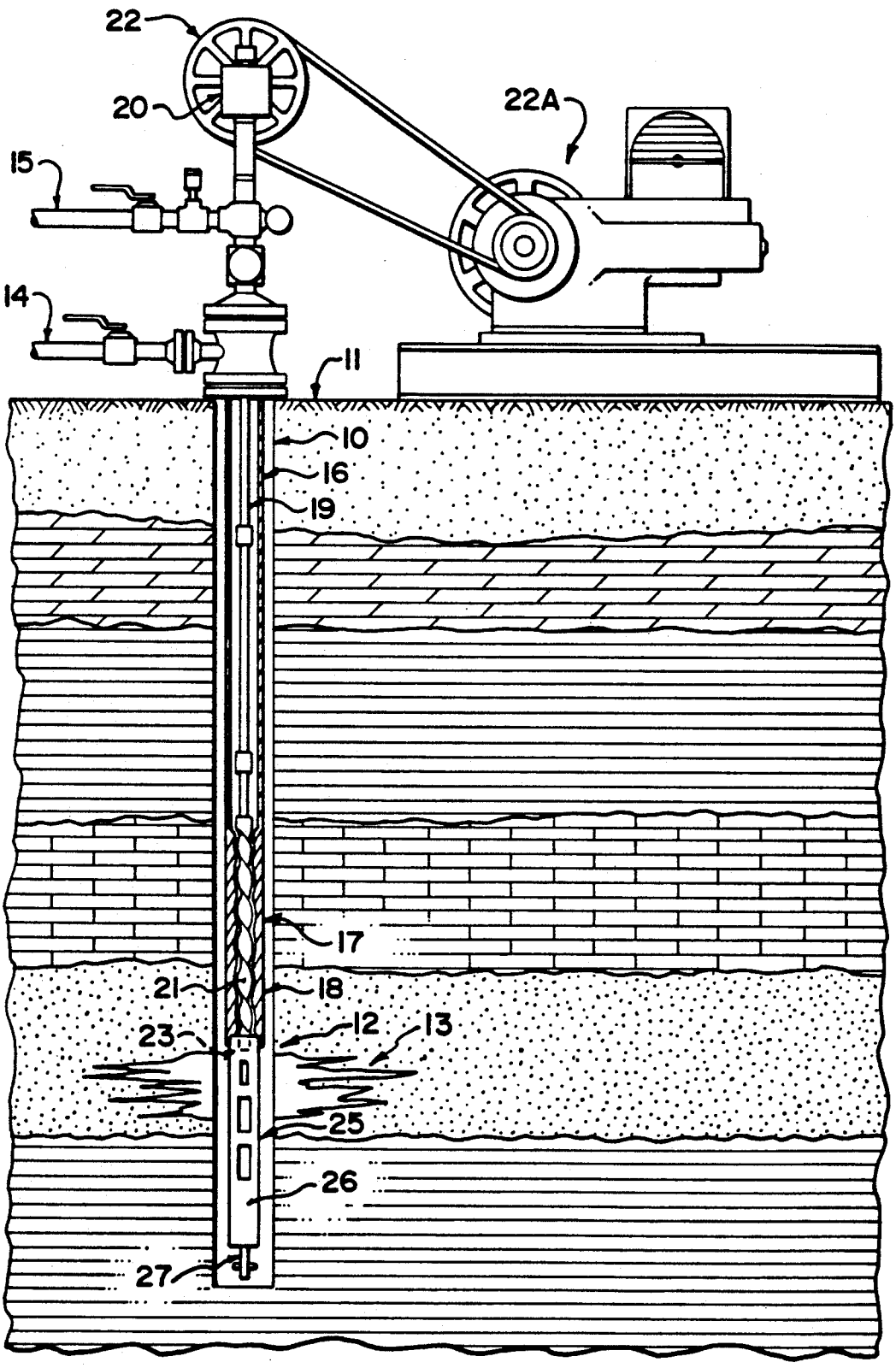
FIG. 1 is a cross sectional view through an oil well pumping system showing the screw pump and the attachment of the present invention.

A conventional well pump system is shown in FIG. 1 including a well casing 10 which extends from the ground surface 11 to the downhole location generally indicated at 12. The producing formation is indicated at 13 which feeds the oil bearing materials including the heavy oil, sand, gas and water into the casing for transmission to the surface. A gas discharge line 14 is provided at an upper end of the casing and liquid discharge line is indicated at 15. The liquid discharge line is connected to a storage tank (not shown) in which separation of the sand, water and oil fractions can occur by a settling process.

Inside the casing 10 is provided a tubing 16 the lower end of which is connected to a screw pump 17 including a stator 18 rigidly connected to the end of the tubing so as to lie stationary within the casing as part of the tubing. A drive shaft or sucker rod assembly is indicated at 19 and extends from a drive gear 20 at the upper end to a rotor 21 at the lower end. The drive gear 20 is driven by a pulley 21 which receives power from a prime mover 22.

The rotor and stator are of the progressing cavity type, examples of which are shown in the above mentioned patents and the details of which are well known to one skilled in the art. The device is therefore shown only schematically.

Conventionally the lower end of the stator 18 includes an opening 23 facing axially of the well into which the oil bearing material passes for a pumping pressure to be generated within the material for transmission to the surface. An attachment according to the present invention is indicated at 25 including a sleeve 26 and a shaft 27 which are shown in more detail in FIGS. 2 through 5.

Figure 5:
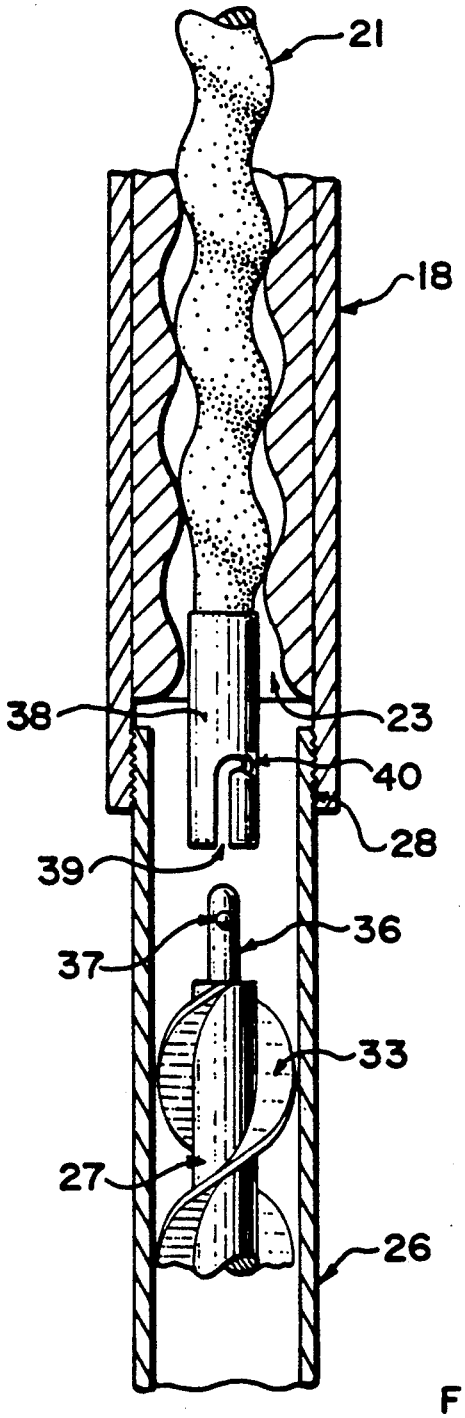
FIG. 5 is a cross sectional view showing an upper part of the attachment and the corresponding lower part of the rotor and stator assembly of the screw pump and showing the coupling therebetween.

The sleeve 26 comprises an elongate hollow sleeve of an outer diameter substantially equal to that of the tubing and the stator. The sleeve includes a screw threaded portion 28 at the upper end by which it can be attached to a female screw threaded portion shown schematically at a lower end of the stator 18 as shown in FIG. 5. The sleeve includes three slots 29, 30 and 31 spaced axially of the sleeve. As shown the openings lie in the same axial plane but it is possible for the openings to be spaced angularly around the sleeve. The openings or perforations allow the material to enter into the sleeve for transmission to the inlet opening 23 of the pump.

The sleeve has a constant smooth inner surface but includes a plug member 32 at the lower end and welded to the lower end.

The shaft 27 has a diameter less than the inner diameter of the sleeve so that it can lie along the inside of the sleeve leaving a space between the shaft and the inner surface of the sleeve. An auger flight 33 is welded to the outer surface of the shaft at the upper end of the shaft and extending approximately over one-half of the length of the shaft leaving a bare portion 34 of the shaft which can slide upwardly and downwardly inside the plug member 32. An inner diameter of the plug member 32 is approximately equal to that of the shaft so that it is a free sliding fit within the plug member.

An upper end of the shaft carries a coupling element 35 in the form of a vertical rod 36 and a transverse pin 37. As shown in FIG. 5 the lower end of the rotor 21 includes a connecting element 38 in the form of a sleeve which is screwed onto a male screw thread portion at the lower end of the rotor. The sleeve is dimensioned to receive on the inside surface the rod 36 and the sleeve includes a pair of J-shaped slots 39 along which the transverse pin 37 can slide in the form of a bayonet fitting. It will be appreciated from FIG. 5, therefore, that if the rotor 21 is moved downwardly onto the rod, the pin 37 can slide along the slots 39, only one of which is shown, and then a turn of the rotor to the left as shown will cause the pin to enter into a base portion 40 of the slots 39 to be latched in place. When latched the shaft 27 can be rotated with the rotor in the left hand direction as shown and can be raised and lowered with the rotor.

The shaft has a collar 41 welded around the shaft at a position spaced downwardly of the bottom end of the auger flight 33. Just beneath the collar 41 is provided a transverse pin 42 which extends through the shaft and projects outwardly to each side. At the lower end of the shaft is provided a further pair of transverse pins 43 and 44 which again project outwardly to either side of the shaft.

The plug member 32 has a central opening dimensioned to receive the shaft as a sliding fit so that when the collar 41 engages the upper surface of the plug member, the collar prevents the shaft from moving further in a downward direction. The collar can effectively transfer the significant load from the shaft onto the plug member. As the collar 41 approaches the upper surface of the plug member 32, the pin 42 passes into a pair of vertical slots 45 cut in the plug member and arranged in opposed position so as to receive the opposed ends of the pin 42.

In assembly of the attachment and pump system of the present invention, firstly the shaft is inserted into the sleeve with the pin 43 on the underside of the plug member 32 and the pin 42 and the collar 41 on the upper side of the plug member 32. The bare portion 34 of the shaft 27 can thus slide up and down within the sleeve between limit stops defined by the collar 41 and the plug member 32 at the lower end of the movement and the underside of the plug 32 and the pin 43 at the upper end of the movement. Under gravity the shaft will fall to the lower end of the movement. The sleeve with the shaft and auger flight inside is then attached to the rotor 18. The rotor 18 is then attached to the tubing and the tubing inserted into the casing of the well. The tubing then slides down inside the casing until the stator and the attachment are located at the producing formation. The rotor and the sucker rods are then inserted inside the tubing and slid downwardly to the position where the rotor reaches the stator. The rotor is free to slide through the stator so that it can be inserted and removed and raised and lowered for adjustment. The auger flight 33 is, however, greater in diameter than the inside diameter of the stator so that the auger flight cannot pass through the stator and hence the auger flight is necessarily positioned on the underside of the stator before the rotor is inserted.

When the rotor reaches the upper end of the shaft 27, the connecting sleeve 38 engages the rod 36. The weight of the sucker rods and the rotor is thus applied to the upper end of the shaft and the rotor is turned so as to engage the pin 37 into the slots 39 and so as to engage the pin 42 into the slots 45 in the plug 32. In this position the shaft is held against rotation so that rotation of the rotor in the leftward direction causes the pin to engage into the base of the slots 39 to provide a coupling or connect position between the rotor and the shaft. By measuring the weight at the upper end of the string including the sucker rods and the rotor, the operator can identify when the rotor has engaged the shaft and the weight of the string is taken up upon the shaft and particularly the collar 41 and the end plug 32. When this occurs and the coupling has taken place, the string including the rotor and the shaft is raised until the pin 43 engages the underside of the plug. This position can again be determined by measuring the weight of the string. As soon as the pin engages the underside of the plug, the operator knows that the device has been raised to the maximum position and then lowers the string by a short distance so that the shaft takes the position shown in FIG. 2. The dimensions of the shaft relative to the rotor and the stator are selected so that in this position the rotor is properly located within the stator for a maximum operation. This also allows the length of the string including the rotor to vary slightly by stretching, which movement is taken up by the sliding of the shaft within the end plug 32.

In order for the rotor to be removed, the operation is reversed so that the rotor and shaft are lowered to the lower position to engage the pin 42 into the slots 45 thus enabling the coupling between the shaft and the rotor to be disconnected and the rotor withdrawn.

In operation of the device in the downhole position, the oil bearing materials enter the sleeve 26 by way of the slot shaped openings 29 and 30. As shown in FIGS. 2 and 3, the openings 29, 30, 31 are aligned with the auger flight 33 and extend only over a part of the periphery of the sleeve 26. The materials are then agitated into a slurry by their engagement with the rotating auger 33 and at the same the materials are transported upwardly along the sleeve towards the inlet opening 23 of the stator. The smaller opening 31 can allow excess sand to escape from the sleeve should the slurry become heavily overburdened with sand since the oil material will tend to rise through the sand during the agitation process thus providing an effective slurry of maximum allowable sand content to the inlet 23 of the pump.

The attachment of the present invention has the following advantages.

1. It is cost efficient by saving on workovers and costly down time.

2. It reduces the need for costly sand baling with service rigs.

3. It is compatible with existing downhole equipment requiring only minor modification of the existing progressing cavity pump system.

4. The pin 37 acts as a shear pin to provide assured unlatching so that the rotor can certainly be removed even in the event of a jamming of the coupling arrangement.

5. It is easy to attach in view of the J-hook coupling arrangement.

6. It provides only minimal extra torque requirements at the surface equipment.

7. It reduces rod torquing during heavy sand kicks into the well by creating a homogenous sand slurry that the pumping equipment can handle.

8. It reduces the risk of stator burnout due to pump starvation caused by sand bridging at the pump inlet.

9. It is designed so that flush-bys or circulating may be done while still in the well.

In one example the sleeve and the shaft are of the order of 48 inches long and the flight is of the order of 25 inches in length. The larger slots 29 and 30 are of the order of 8 inches in length and 2 inches in width. The smaller slot 31 is of the order of 1½ inches in width and 5 inches in length.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A rotary well pump system for pumping oil bearing fluid material from a producing formation to the ground surface, the system comprising a tubing extending from the ground surface to a position adjacent the producing formation, a screw pump located adjacent the producing formation and having a stator and a rotor, the stator being attached to the tubing and having an inlet opening facing in an axially downward direction for receiving the oil bearing material from the producing formation, a drive rod extending from a drive system at the ground surface to the rotor for driving the rotor in the stator to generate a pumping pressure in the fluid material entering said inlet opening for transmission by the pressure generated through the tubing to the surface, a sleeve member having a peripheral wall surrounding and extending axially from said inlet opening through which the oil bearing material passes to said inlet opening, a shaft extending axially of the sleeve, means connecting said shaft to said rotor for rotation therewith, an auger flight carried by said shaft and rotatable therewith inside said sleeve and at least one opening provided through the peripheral wall extending around a part only of the peripheral wall and at a position aligned with the auger flight such that rotation of said rod in a pumping direction causes the auger flight to feed said oil bearing material longitudinally of the sleeve towards said inlet opening.

2. The invention according to claim 1 wherein there is provided at least two openings in the side of the sleeve spaced axially of the sleeve one of said openings closer to said inlet opening being smaller than another of said openings.

3. The invention according to claim 1 wherein the auger flight has an external dimension greater than an internal dimension of the stator.

4. The invention according to claim 1 wherein the sleeve includes a threaded end portion for coupling to the stator.

5. A rotary well pump system for pumping oil bearing fluid material from a producing formation to the ground surface, the system comprising a tubing extending from the ground surface to a position adjacent the producing formation, a screw pump located adjacent the producing formation and having a stator and a rotor, the stator being attached to the tubing and having an inlet opening facing in an axially downward direction for receiving the oil bearing material from the producing formation, a drive rod extending from a drive system at the ground surface to the rotor for driving the rotor in the stator to generate a pumping pressure in the fluid material entering said inlet opening for transmission by the pressure generated through the tubing to the surface, a sleeve member having a peripheral wall surrounding and extending axially from said inlet opening through which the oil bearing material passes to said inlet opening, a shaft extending axially of the sleeve, means connecting said shaft to said rotor for rotation therewith, an auger flight carried by said shaft and rotatable therewith inside said sleeve and at least one opening provided through the peripheral wall such that rotation of said rod in a pumping direction causes the auger flight to feed said oil bearing material longitudinally of the sleeve towards said inlet opening wherein said means connecting the shaft to the rotor defines a releasable coupling arrangement having a release position and a connect position and arranged to move from the release position to the connect position by rotational movement of the rotor relative to the shaft.

6. The invention according to claim 5 including cooperating means on the sleeve and the shaft for latching the shaft against rotation to hold the shaft for movement into the connect position, said cooperating means being responsive to movement of the shaft in an axially downward direction within the sleeve.

7. The invention according to claim 5 wherein said shaft is slidable longitudinally of the sleeve, said auger flight being shorter from the shaft leaving a portion of the shaft free from said auger flight to allow said sliding movement, and including cooperating first and second stop means on the shaft and on the sleeve allowing longitudinal movement of the shaft relative to the sleeve between upper and lower limits of movement defined by said first and second stop means respectively.

8. The invention according to claim 7 wherein the first stop means includes a collar member fixed to and surrounding the shaft for resting against a cooperating ring at a lower end of the sleeve.

9. A rotary well pump system for pumping oil bearing fluid material from a producing formation to the ground surface, the system comprising a tubing extending from the ground surface to a position adjacent the producing formation, a screw pump located adjacent the producing formation and having a stator and a rotor, the stator being attached to the tubing and having an inlet opening facing in an axially downward direction for receiving the oil bearing material from the producing formation, a drive rod extending from a drive system at the ground surface to the rotor for driving the rotor in the stator to generate a pumping pressure in the fluid material entering said inlet opening for transmission by the pressure generated through the tubing to the surface, a sleeve member having a peripheral wall surrounding and extending axially from said inlet opening through which the oil bearing material passes to said inlet opening, a shaft extending axially of the sleeve, means connecting said shaft to said rotor for rotation therewith, an auger flight carried by said shaft and rotatable therewith inside said sleeve and at least one opening provided through the peripheral wall such that rotation of said rod in a pumping direction causes the auger flight to feed said oil bearing material longitudinally of the sleeve towards said inlet opening wherein said shaft is slidable longitudinally of the sleeve, said auger flight being shorter from the shaft leaving a portion of the shaft free from said auger flight to allow said sliding movement, and including cooperating first and second stop means on the shaft and on the sleeve allowing longitudinal movement of the shaft relative to the sleeve between upper and lower limits of movement defined by said first and second stop means respectively.

* * * * *